US009231345B2

(12) United States Patent
Chamura

(10) Patent No.: US 9,231,345 B2
(45) Date of Patent: Jan. 5, 2016

(54) CONNECTOR AND CONNECTOR DEVICE

(71) Applicant: Hirose Electric Co., Ltd., Tokyo (JP)

(72) Inventor: Shingo Chamura, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 14/100,803

(22) Filed: Dec. 9, 2013

(65) Prior Publication Data

US 2014/0187104 A1 Jul. 3, 2014

(30) Foreign Application Priority Data

Dec. 27, 2012 (JP) ..... 2012-285088

(51) Int. Cl.
*H01R 13/62* (2006.01)
*H01R 13/639* (2006.01)
*H01R 13/625* (2006.01)

(52) U.S. Cl.
CPC ..... *H01R 13/639* (2013.01); *H01R 13/625* (2013.01)

(58) Field of Classification Search
CPC ..... H01R 13/6392; H01R 13/625
USPC ..... 439/367, 314
See application file for complete search history.

(56) References Cited

U.S. PATENT DOCUMENTS 6,669,502 B1 * 12/2003 Bernhart et al. ..... 439/460
7,303,418 B2 * 12/2007 O'Connor ..... 439/277

FOREIGN PATENT DOCUMENTS

JP 2003-243108 A 8/2003

* cited by examiner

*Primary Examiner* — Abdullah Riyami
*Assistant Examiner* — Thang Nguyen
(74) *Attorney, Agent, or Firm* — Kubotera & Associates, LLC

(57) ABSTRACT

A connector is to be connected to a mating connector. The connector includes a base portion for accommodating a plug and a cable connected to the plug; a connecting member disposed on the base portion to be rotatable relative to the mating connector for connecting the connector to the mating connector; a tightening member disposed on the base portion to be movable relative to the connecting member for tightening the cable; and a rotation preventing member disposed on the base portion to be movable relative to the connecting member for engaging with the connecting member so that the rotation preventing member prevents the connecting member from rotating relative to the mating connector.

7 Claims, 9 Drawing Sheets

CONNECTOR AND CONNECTOR DEVICE

BACKGROUND OF THE PRESENT INVENTION AND RELATED ART STATEMENT

The present invention relates to a connector and a connector device using the connector. In particular, the present invention relates to a connector capable of preventing a wrong operation.

Patent Reference has disclosed a conventional connector having a configuration similar to that of the present invention. FIG. 9 shows a conventional connector disclosed in Patent Reference.

Patent Reference: Japanese Patent Application Publication No. 2003-243108

The conventional connector disclosed in Patent Reference has a generally cylindrical shape as a whole, and is fitted to a mating connector in a state that the conventional connector retains a plug 112 and at least a part of a cable (cord) 110, one end of which is connected to the plug 112. The conventional connector is provided with a plug main body 120 on a side thereof for fitting to the mating connector. Similar to a typical connector, the plug main body 120 can be freely attached to and detached from the mating connector, for example, by rotating relative to the mating connector. On the other hand, on the side opposite to the mating connector, the conventional connector is provided with a member for tightening the cable 110, i.e., a cylindrical packing 132 and a packing main body 130 for screwing to fit to a male threaded fitting 136, which is a coupling component, via the cylindrical packing 132.

In the conventional connector disclosed in Patent Reference, the plug 112 has a mechanical latch 116 that operates with a knob 118. With the mechanical latch 116, it is possible to lock the plug 112 into a receptacle 122 that is provided in the mating connector. In the conventional connector disclosed in Patent Reference, it is characterized that the receptacle 122 is provided for canceling an action of the mechanical latch 116. Needless to say, a typical connector does not include such canceling function.

According to the conventional connector described in Patent reference, when the receptacle 122 is not provided for canceling the action, i.e., in case of a typical connector not having the canceling function, even when the tightening member for tightening the cable such as the cylindrical packing 132 or the packing main body 130 is not loosen, it is still possible to loosen the fitting of the connector to the mating connector by rotating the plug main body 120. Therefore, (although there is no problem when the function of the mechanical latch 116 of the plug 112 is canceled as in Patent Reference), when the plug 112 is locked onto the receptacle 122 provided in the mating connector and the cable 110 remains clamped with the tightening member, it is difficult to separate the connector from the mating connector. In other words, it is difficult to separate the connector from the mating connector, since the plug 112 is locked on the receptacle. However, it is still possible to pull the cable 110, which is secured on the tightening member of the connector, with the connector. As a result, there is a risk of damaging the locking structure between the plug 112 that is connected to the cable 110 and the receptacle.

In view of the problems of a conventional connector disclosed in Patent Reference that does not have the canceling function, an object of the present invention is to provide a connector and a related product thereof having a configuration, in which a coupling member thereof is difficult to rotate unless engagement between a tightening member and a coupling member is loosen, i.e., unless the tightening member is moved to a side opposite to the coupling member, so that the tightening member is loosen from clamping a cable. Accordingly, it is possible to prevent the connector and the related product from being damaged caused by wrong handling. It should be noted that, when a connector has a canceling mechanism, there is no such a problem. As in the conventional connector disclosed in Patent Reference, however, when the connector has the canceling function, the plug and the receptacle are not locked to each other, so that there is a problem of not being able to secure sufficient connected state. Therefore, the conventional connector disclosed in Patent Reference is not considered as preferred configuration.

Further objects and advantages of the present invention will be apparent from the following description of the present invention.

SUMMARY OF THE PRESENT INVENTION

In order to obtain the objects described above, according to the present invention, a cylindrical connector is to be freely attached to and detached from a mating connector, while being in a state of having inside thereof a plug having a locking section that is to be locked onto a receptacle provided in the mating connector and at least a part of a cable, one end of which is connected to the plug.

According to a first aspect of the present invention, the connector includes a base portion, which extends along the cable while having inside thereof the plug and at least a part of the cable and rotation of which relative to the mating connector is restricted upon fitting the connector to the mating connector; a coupling member, which is provided in the base portion in a state of being rotatable relative to the mating connector and connects the connector to the mating connector by rotating relative to the mating connector to attach thereto upon fitting the connector to the mating connector; a tightening member, which is provided on the base portion on the side opposite the mating connector relative to the connector, while being in a state of being movable along the cable towards the coupling member side, and clamps the cable as it moves towards the coupling member; and a rotation preventing member, which moves to the coupling member side according to the movement of the tightening member towards the coupling member side and prevents rotation relative to the coupling member by engaging with a specific portion of the coupling member while being in a state the rotation relative to the base portion is restricted.

According to the above-described configuration, unless the engagement between the tightening member and the coupling member is loosened, it is impossible to rotate the coupling member. Therefore, the engagement between the connector and the mating connector will not be released by rotating the coupling member without loosening the clamping of the cable with the tightening member. Accordingly, it is possible to prevent connection problems between the plug and the receptacle due to wrong handling.

According to a second aspect of the present invention, the tightening member of the connector is configured to be able to loosen the clamping of the cable as it moves away from the coupling member along the cable. The rotation preventing member moves away from the coupling member as the tightening member moves away from the coupling member, and disengage from the specific portion of the coupling member so as to allow the rotation of the coupling member.

According to the above-described configuration, it is impossible to rotate the coupling member unless the clamping of a cable with the tightening member is loosened by moving the tightening member to the opposite side to the coupling member. Therefore, the fitting of the connector to the mating connector will not be loosened by rotating the coupling member without loosening the clamping of the cable with the tightening member as in a conventional connector. With the configuration, it is achievable to prevent connection damage between the plug and the receptacle due to wrong handling after fitting.

Furthermore, according to a third aspect of the present invention, of the tightening members, at least an outside member that is exposed outside is provided in a state of being rotatable relative to the rotation preventing member on the opposite side the mating connector relative to the rotation preventing member in the base portion. Each of the tightening member and the base portion has a screw portion, which is provided to correspond to each other. With the correspondence between the screw portion of the outside member and the screw portion of the base portion, the outside member is moved to the coupling member side by screw action, and the rotation preventing member provided between the coupling member and the outside member can be moved to engage a specific part of the coupling member and a specific part of the rotation preventing member. Since there is the base portion, it is possible to group a front shell mainly composed of the coupling member and the base portion and a rear shell mainly composed of the rotation preventing member and the tightening member, and thereby it is possible to simplify the structure.

According to a fourth aspect of the present invention, the directions of the rotation preventing member and the coupling member may be adjusted before that the rotation preventing member and the coupling member engage to each other, by a positioning member respectively provided on the rotation preventing member and the base portion. Using the base portion, it is possible to adjust the direction of the rotation preventing member and the coupling member in advance.

According to a fifth aspect of the present invention, it is also possible to further provide a member in each of the rotation preventing member and the coupling member, which restricts rotation of the rotation preventing member relative to the base portion and also adjust the directions of the rotation preventing member and the coupling member before the rotation preventing member and the coupling member engage to each other.

With the configuration, it is possible to prevent the rotation of the rotation preventing member relative to the mating connector and can securely and smoothly have the rotation preventing member and the coupling member engage to each other.

The connector can be a waterproof connector, and can be provided as a set with the mating connector. In addition, another aspect of the present invention may be a connector device composed of the above-described connector and the mating connector thereof. Furthermore, yet another aspect of the present invention is a connector member that composes the base portion, the coupling member, and the tightening member, which are used in the connector.

According to the present invention, unless the engagement between the tightening member and the coupling member is loosened, it is impossible to rotate the coupling member. Therefore, it is possible to provide a connector and related articles, which can prevent the device from damages by erroneous operations.

DETAILED DESCRIPTION OF THE PREFERRED EMBODIMENTS

Hereunder, an embodiment of the present invention will be described with reference to the accompanying drawings. Here, the embodiment will be described with an example of a plug connector 2 as a waterproof connector or a waterproof device 1 using the plug connector 2 as a waterproof connector. As obvious from the description, however, the present invention may be applicable not only to such waterproof connector, but also applicable to various plug connectors such as optical connectors and electrical connectors.

Figure 1:
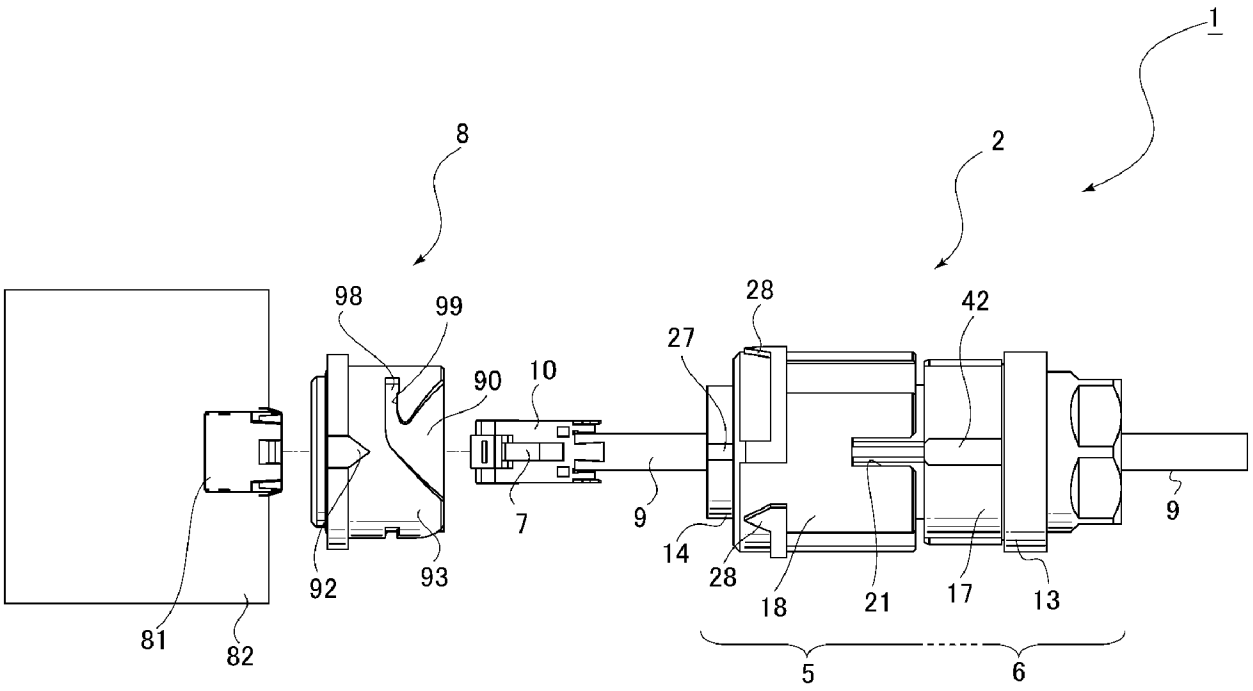
FIG. 1 is a plane view showing an example of a waterproof device with peripheral members thereof according to an embodiment of the present invention.

FIG. 1 is a plane view showing an example of the waterproof device 1 with a peripheral member thereof. The device 1 includes a set of a cylindrical plug connector (waterproof connector) 2 and a receptacle connector (mating connector) 8, which can fit to each other so as to be freely attachable to and detachable from each other. Here, FIG. 1 schematically illustrates a state in use of the waterproof device 1 for easy understanding, and may be different from actual state of the use. More specifically, in the state of actual use, a receptacle 81 provided in the receptacle connector 8 will not be exposed to outside since it is accommodated in the housing 82 and the receptacle connector 8 attached thereto. Similarly, a plug 10 provided in the plug connector 2 and at least a part of the cable 9, one end of which is connected to the plug 10, is in a state of being accommodated in the receptacle connector 8 and the plug connector 2, and will not be exposed to outside. Here, the plug 10 and the receptacle 81 may be considered as the ones having configurations similar to conventional ones. The plug 10 is locked in the receptacle 81 with a latching piece 7 by a similar method to the conventional one, and such locked state will not be loosen unless loosening operation is performed with the latching piece 7.

The plug connector 2 and the receptacle connector 8 are fitted to each other by a bayonet connection. For the bayonet connection, on an outer surface of a cylindrical section 93 of the receptacle connector 8, there is provided a securing groove 90, in which a recess 98 is formed on an end passed the projecting section 99. Correspondingly, on an inner circumferential surface on edge side of a sleeve 18 of the plug connector 2, there is provided a protrusion (a protrusion 26 shown in the sectional view of FIG. 2(*b*), which will be described later).

Figure 2:
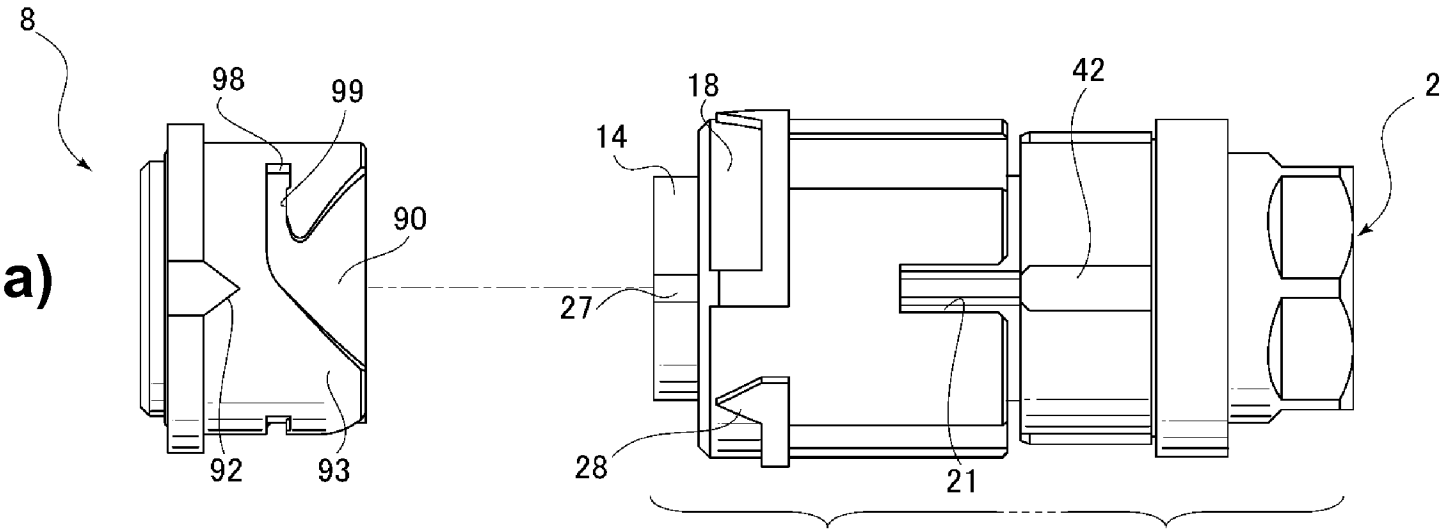
FIGS. 2(*a*) and 2(*b*) are a plane view and a vertical sectional view of a connector and a mating connector thereof.
Figure 2:
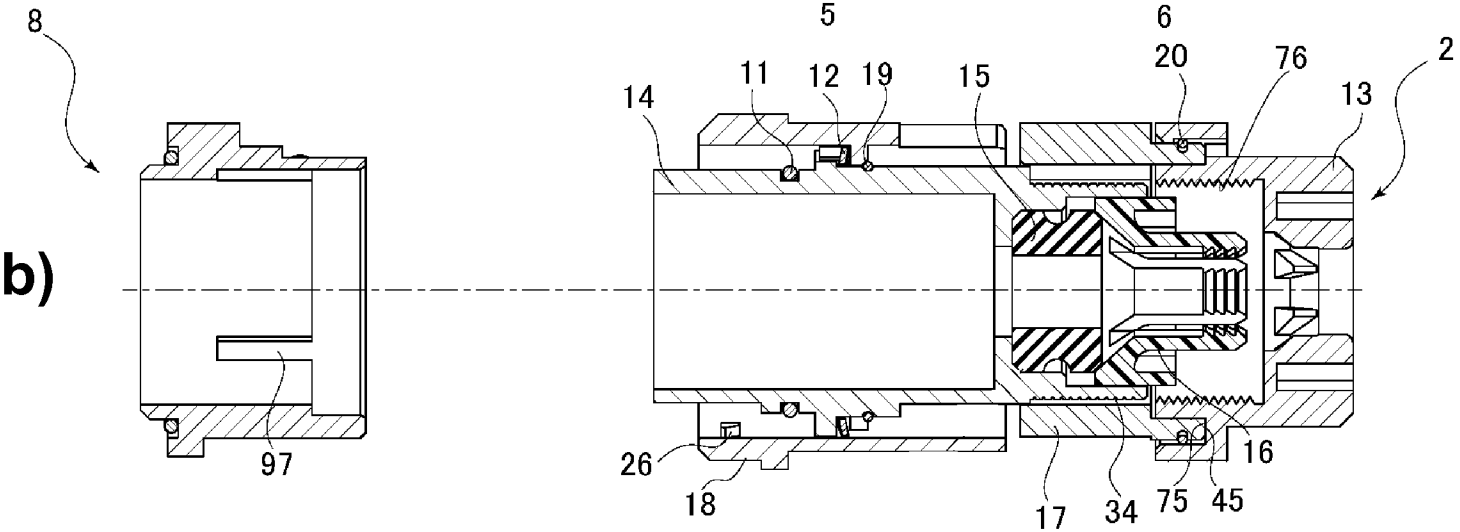

Upon securing by the bayonet connection, first visually checking the positions of a positioning marking 28 provided in the plug connector 2 and a positioning marking 92 provided in the receptacle connector 8 corresponding to the positioning marking 28, a guiding protrusion 27 for positioning provided in an insulating case 14 of the plug connector 2 is inserted in a guiding recess of the receptacle connector 8 (a guiding recess 97 shown in the sectional view of FIG. 2(*b*), which will be described below). Then, after pushing the protrusion 26 of the sleeve 18 in a securing groove 90 of a cylindrical section 93 along an axial direction thereof, the sleeve 18 is rotated relative to the receptacle connector 8 along an outer surface of the cylindrical section 93 so as to let the protrusion 26 of the sleeve 18 move across the projecting section 99 and fall in a recess 98.

Here, the receptacle connector 8 is secured in a housing or the like, so that the guiding recess 97 of the receptacle connector 8 is also in a secured state. As a result, when the guiding protrusion 27 of the insulating case 14 is in a state of being inserted in the guiding recess 97 of the receptacle connector 8, the rotation of the insulating case 14 relative to the receptacle 8 is restricted. More specifically, unless the insulating case 14 is pulled out from the guiding recess 97 of the receptacle connector 8, that is, unless the bayonet connection is disconnected by rotating the sleeve 18, the insulating case 14 will not rotate relative to the receptacle 8.

Figure 3:
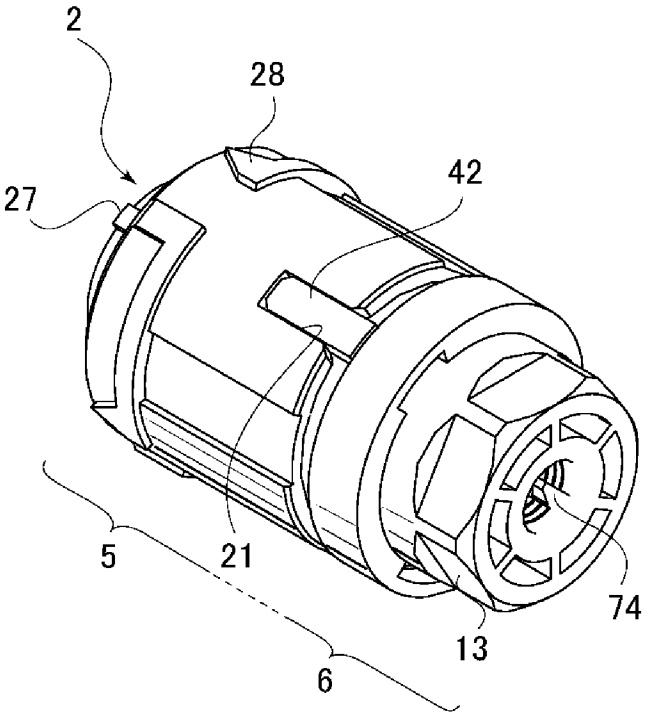
FIGS. 3(*a*) and 3(*b*) are a front perspective view and a rear perspective view of the connector.
Figure 3:
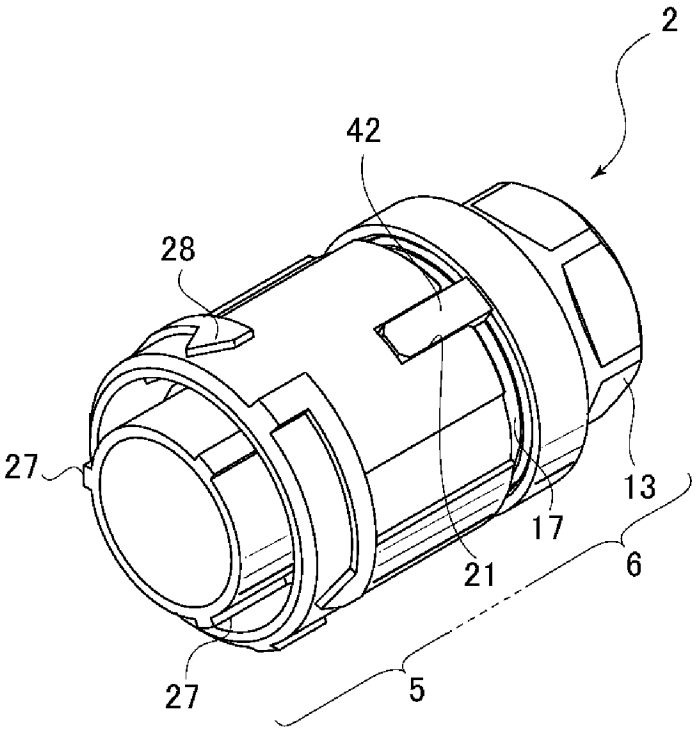

FIGS. 2(*a*) and 2(*b*) are views, in which only the plug connector 2 and the receptacle connector 8, which compose the device 1, are extracted from FIG. 1. FIG. 2(*a*) is a plane view of the plug connector 2 and the receptacle connector 8 and FIG. 2(*b*) is a vertical sectional view of those connectors 2 and 8, in a similar manner to FIG. 1. In addition to FIGS. 2(*a*) and 2(*b*), FIG. 3(*a*) is a front perspective view showing only the plug connector 2 and FIG. 3(*b*) is a rear perspective view only showing the plug connector 2.

For convenience, the plug connector 2 may be generally divided into two parts; a front shell 5 provided on a side of the receptacle connector 8 and a rear shell 6 provided on the opposite side to the receptacle connector 8. The front shell 5 and the rear shell 6 are screwed to secure each other by fitting a male threaded surface 34 provided on the front shell 5 to a female threaded surface 76 provided on the rear shell 6. Inside the front shell 5 and the rear shell 6, there are provided a gasket 15 and an annular clamp 16 on the opposite side to the receptacle 8 relative to the sleeve 18. The gasket 15 is a donut-shaped member made of rubber and the clamp 16 is a cleaved sleeve-like resin member having a plurality of split pieces 62, and those members 15 and 16 serve for clamping a cable inserted in the plug connecter 2 in corporation with a part of the rear shell (tightening ring 13). Therefore, the gasket 15, the clamp 16, and the tightening ring 13 serve as tightening members in the present invention.

Figure 4:
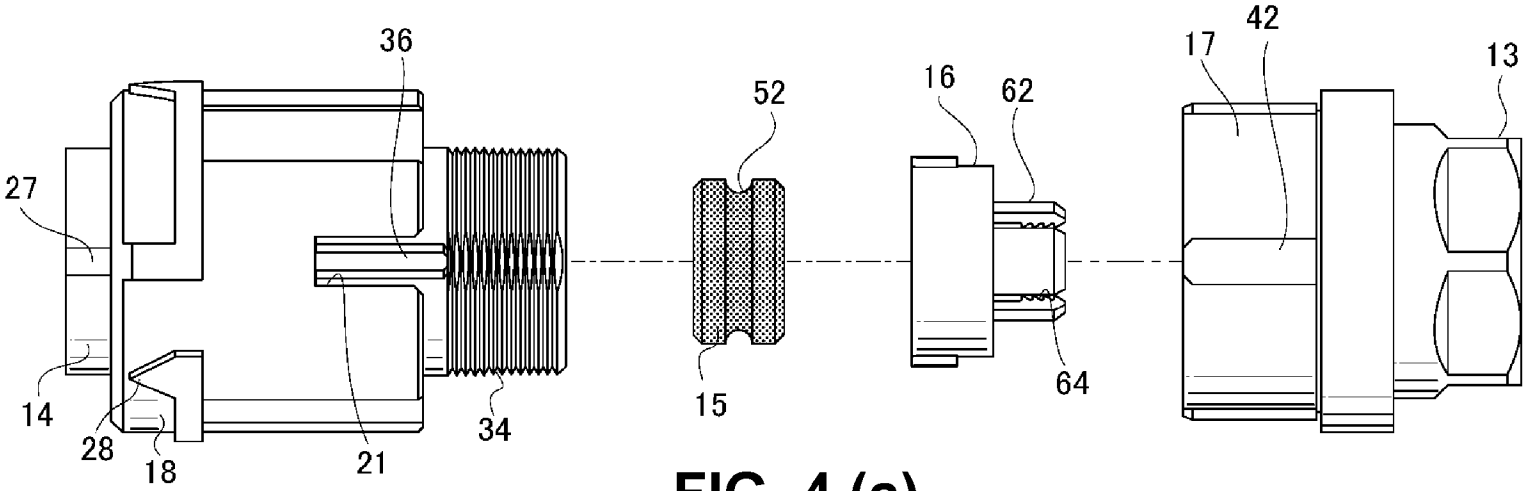
FIGS. 4(*a*) and 4(*b*) are views showing the connector where a front shell and a rear shell thereof are separated, and a gasket and a clamp provided therein are taken out therefrom.
Figure 4:
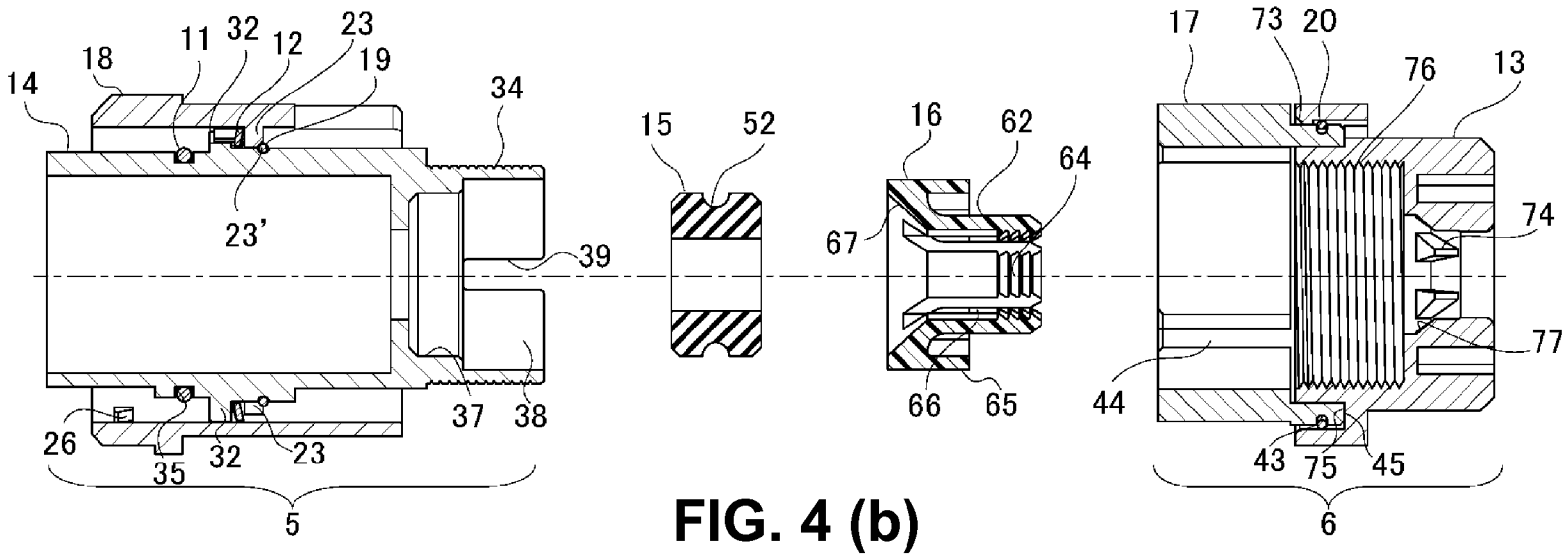
Figure 5:
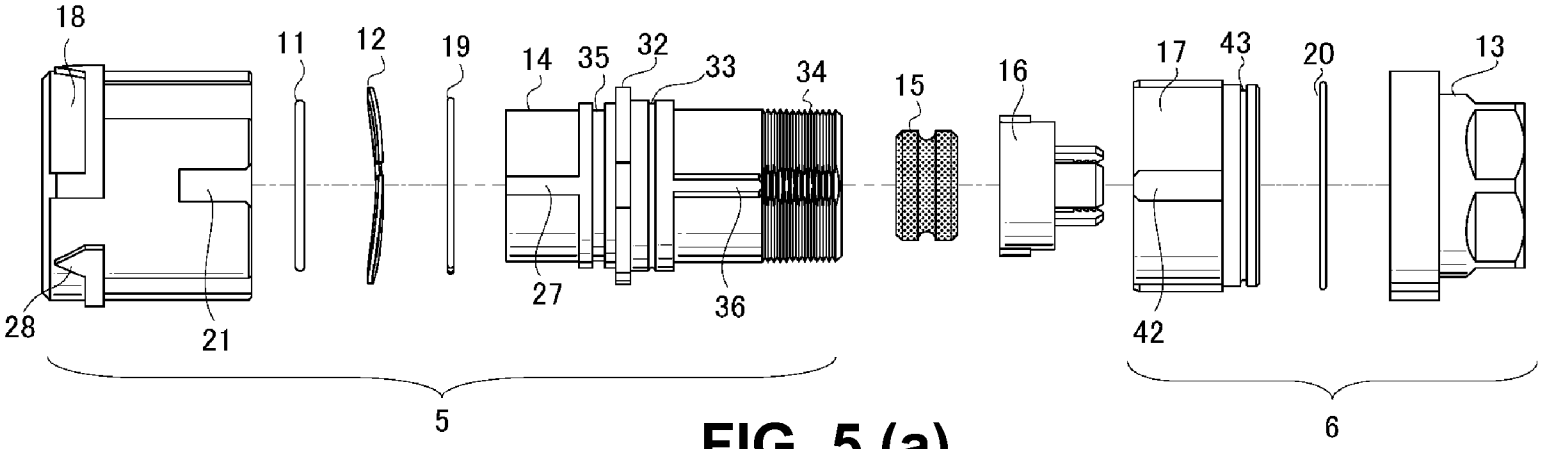
FIGS. 5(*a*) and 5(*b*) are an exploded plane view and a vertical sectional view, in which all components of the front shell and the rear shell of the connector are disassembled.
Figure 5:
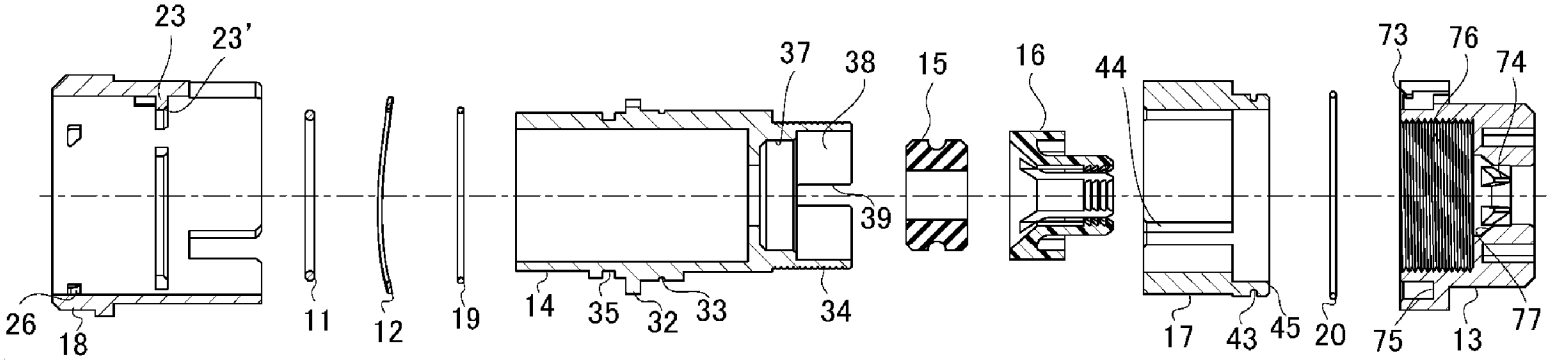

FIGS. 4(*a*) and 4(*b*) shows a view, in which the front shell 5 and the rear shell 6 are separated from each other and the gasket 15 and the clamp 16 provided therein are separated therefrom, in a similar manner to that of FIG. 2. FIGS. 5(*a*) and 5(*b*) are exploded perspective views of all the components of the front shell 5 and the rear shell 6 separated from each other in a similar manner to that of FIGS. 2(*a*) and 2(*b*). Furthermore, FIGS. 6(*a*) and 6(*b*) are perspective views of representative components of the front shell 5 and the rear shell 6, whereas FIG. 6(*a*) is a front perspective view and FIG. 6(*b*) is a rear perspective view thereof.

The front shell 5 includes an insulating case (base portion) 14 formed as a cylindrical body; an annular sleeve (coupling member) 18 attached so as to cover surrounding of the insulating case 14; a stopper ring 19 for connecting the insulating case 14 to the sleeve 18; a C-shaped wave washer 12 having elastic action; and further includes a waterproof O-ring 11. Of those components, FIGS. 6(*a*) and 6(*b*) show only the insulating case 14 and the sleeve 18.

The insulating case 14 extends along the cable 9, while having therein the plug 10 and at least a part of the cable 9 (see FIG. 1). The sleeve 18 is provided on a side of the receptacle connector 8 relative to the insulating case 14, and is capable of rotating relative to the insulating case 14 at a specific position of the insulating case 14. Here, the sleeve 18 does not rotate relative to the insulation case 14 without limitation, and the angular range of the rotation is limited to about 120 degrees.

In addition, according to the configuration, as shown in FIGS. 4(*a*) and 4(*b*), when the sleeve 18 rotates relative to the insulating case 14 to the optimum position for the bayonet connection, a key groove 21 provided on the sleeve 18 and the guiding protrusion 36 provided on the insulating case 14 are considered to be adjusted so as to be at positions to just overlap to each other in the plane view direction. Since the configuration for this is obvious for a person skilled in the art, detailed explanation will be omitted. The stopper ring 19 is fitted in the annular recess 33 of the insulating case 14. Even after fitting therein, an upper part of the stopper ring 19 is somewhat sticking out from the annular recess 33, and an annular inner flange 23 of the sleeve 18 is disposed between the part of the stopper ring 19 that sticks out therefrom and an annular outer flange 32 of the insulating case 14 via the wave washer 12. Here, in order to securely achieve the connection between the stopper ring 19 and the annular inner flange 23, an annular inclination 23' may be provided on a surface of the annular inner flange 23.

With action of the wave washer 12, the sleeve 18 is always energized to the rear side of the insulating case 14, i.e., on the side opposite the receptacle connector 8. This energizing force generates a clicking feeling upon fitting the plug connector 2 to the receptacle connector 8. The O-ring 11 is fitted in an annular recess 35 of the insulating case 14, which is provided on a side of the receptacle connector 8, and fills the gap from the receptacle connector 8 upon fitting to the receptacle connector 8. With this configuration, it is possible to more securely prevent damage of the connection therebetween.

Figure 6:
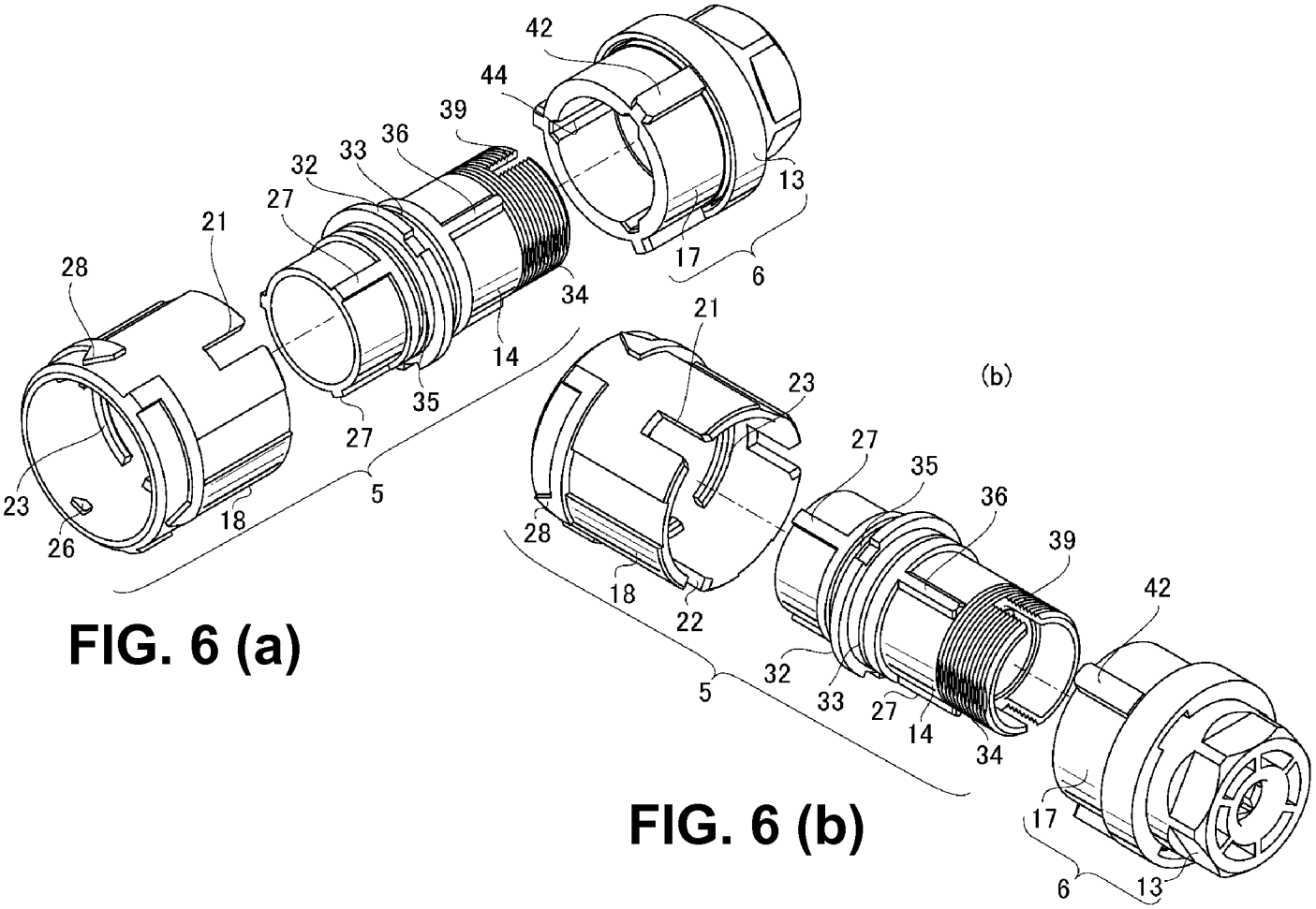
FIGS. 6(*a*) and 6(*b*) are perspective views of representative components of the front shell and the rear shell of the connector, respectively.

The rear shell 6 includes a key ring 17, the tightening ring 13, and a rotation retaining ring 20 to connect between the key groove 17 and the tightening ring 13. FIGS. 6(*a*) and 6(*b*) show a whole view of the rear shell 6.

On the rear side of the key ring 17, i.e., around the opposite side of the key ring 17 to the receptacle connector 8, there is provided an annular recess 43. The rotation retaining ring 20 is disposed while having an upper part thereof somewhat stick out from the recess 43. At the part that sticks out, by fitting the key ring 17 to the tightening ring 13 while hooking a hooking section 73 of the tightening ring 13, the tightening ring 13 is disposed on the key ring 17 on the opposite side to the receptacle connector 8, and can rotate relative to the key ring 17 at a specified position of the key ring 17. The key ring 17 serves as a rotation preventing member in the present invention.

The tightening ring 13 is provided while being exposed to outside of the plug connector 2. The tightening ring 13 is an outside member that forms a part of the tightening members with the gasket 15 and the clamp 16, which are provided in the front shell 5 and the rear shell 6, and has a function of clamping a cable 9 inserted in the plug connector 2 and secure it therein. On an inner wall of the tightening ring 13 on a side of the receptacle connector 8, there is provided a threaded surface 76 corresponding to the threaded surface 34 of the insulating case 14. With screwing action of the threaded surfaces 34 and 76, the tightening ring 13 and the tightening members such as the gasket 15 and the clamp 16 provided therein can move along the cable to the sleeve 18 side.

A part of the tightening ring 13 (front abutting surface 75 shown in FIGS. 5(*a*) and 5(*b*)) is abutted to a part of the key ring 17 (rear abutting surface 45 shown in FIG. 5). Through abutting of those abutting surfaces 75 and 45, the key ring 17 provided between the sleeve 18 and the tightening ring 13 responds to the movement of the tightening ring 13 to move to the sleeve 18 side. As a result, a specific part of the key ring 17, e.g., a protruding key 42 provided along the cable 9, engages with a specific part of the key ring 17, e.g., the key ring 21 provided along the cable. As will be described, with the engagement, upon fitting the plug connector 2 to the receptacle connector 8, it is possible to prevent the sleeve 18 from rotating relative to the receptacle connector 8.

In order to restrict orientation of the key ring 17 relative to the insulating case 14, on an outer wall of the insulating case 14, there is provided a plurality of guiding protrusions 36 that extend along the cable 9 and is provided thereon at equal angular intervals. While the guiding protrusions 36 of the insulating case 14 and the guiding groove 44 of the key ring 17 are engaged, with the threaded surface 76 of the tightening ring 13 and the threaded surface 34 of the insulating case 14 are screwed to secure each other, the key ring 17 is attached thereon at a specific direction relative to the insulating case 14 with the tightening ring 13.

Figure 7:
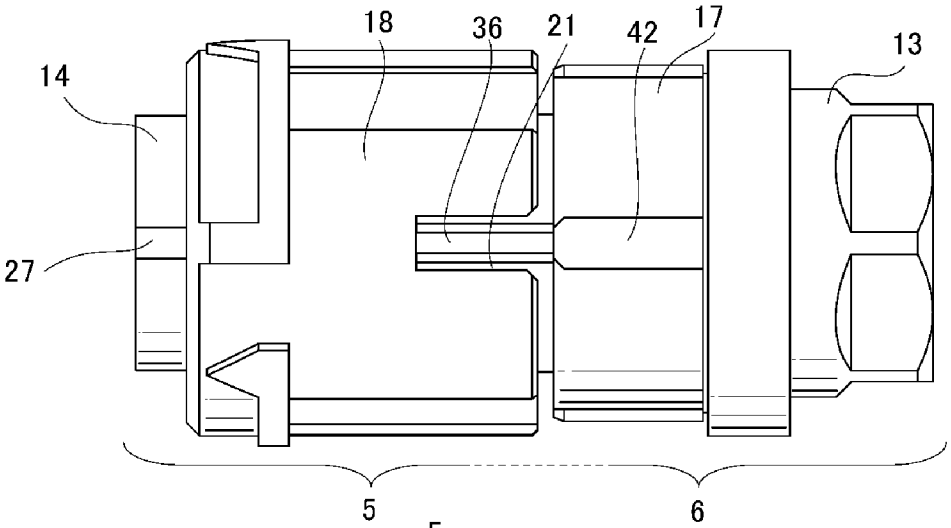
FIGS. 7(*a*) and 7(*b*) are plane views showing an operation of the connector.
Figure 7:
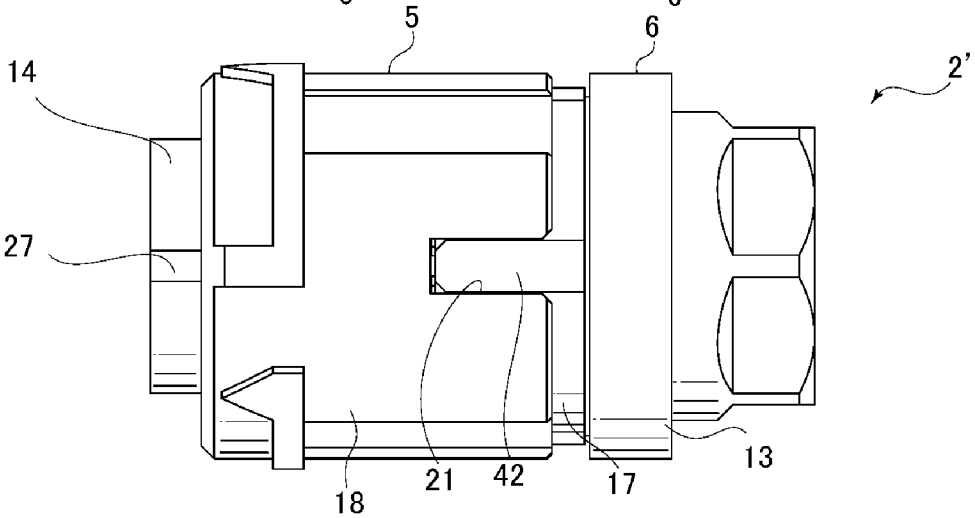

The guiding protrusions 36 of the insulating case 14 and the guiding grooves 44 of the key ring 17 are critical also for adjusting the directions of the key ring 17 and the sleeve 18. FIGS. 7(*a*) and 7(*b*) show a plane views showing before and after the protruding key 42 of the key ring 17 and the key groove 21 of the sleeve 18 are engaged.

Here, it should be specially noted that the guiding protrusions 36 of the insulating case 14 extend behind over the key groove 21, i.e., to a position opposite the receptacle connector 8. As well shown in FIG. 7(*a*), since the guiding protrusions 36 of the insulating case 14 and the guiding grooves 44 of the key ring 17 are engaged, the protruding key 42 of the key ring 17 and the key groove 21 of the sleeve 18 are always engaged at a precise position.

Next, referring to sectional views of FIGS. 2(*a*), 2(*b*), FIGS. 4(*a*), 4(*b*), and FIGS. 5(*a*) and 5(*b*) as well as FIGS. 7(*a*) and 7(*b*), clamping action and loosening action from the clamping will be described.

The gasket 15 is disposed in an annular recess 37 having a small diameter of the insulating case 14, whereas the clamp 16 is disposed in a circular space having a large diameter of the insulating case 14 that is continuously provided to the annular recess 37. When the tightening ring 13 is rotated relative to the insulating case 14 in a specific direction, the threaded surface 76 of the tightening ring 13 and the threaded surface 34 of the insulating case 14 engage with each other, and thereby the tightening ring 13 moves to the insulating case 14 side. Responding to the movement, the tightening ring 13 pushes the clamp 16 towards the gasket 15 side, and the clamp 16 pushes the gasket 15 to the insulating case 14 side.

On the side of the clamp 16 for contacting with the tightening ring 13, a plurality of split pieces 62 extends. The end sides of the split pieces 62 abut the inclination 77 of the tightening ring 13 and thereby are displaced towards the cable 9 by action of the inclination 77. On an inner side of the ends of the split pieces 62, there is provided a plurality of nonslip protrusions 64, and with those protrusions 64 displaced towards the cable, it is possible to securely clamp the cable 9. Here, in gaps between the split pieces 62, an anti-recovering protrusion 74 provided on the inclination 77 goes in, and thereby it is possible to control the rotation of the clamp 16 in a certain direction.

In addition, on the side of the clamp 16 for contacting with the gasket 15, there is formed an inclination 67. The gasket 15 can reduce its diameter by action of the inclination 67 on the side of a contacting surface to the clamp 16. Furthermore, since there is provided an annular groove 56 on a center outer surface of the gasket 15, as the annular groove 52 is deformed, the gasket will have a smaller diameter also in an area around the center thereof. As a result, also near the center of the gasket 15, the cable is tightly held with the gasket 15. Here, it is also possible to define the position of the clamp 16 in the insulating case 14 by providing a guiding groove 39 in a large-diameter circular space 38 of the insulating case 14 and positioning with the protruding section 65 on the outer surface of the clamp 16.

On the other hand, when the tightening ring 13 is rotated relative to the insulating case 14 in a direction opposite to the above-described specific direction, with engagement between the threaded surface 76 of the tightening ring 13 and the threaded surface 34 of the insulating case 14, the tightening ring 13 moves to the side opposite to the insulating case 14. Responding to the movement, the clamp 16 is released from the tightening ring, and the split pieces of the clamp 16 recover to the original conditions to release the tightening of the cable. The gasket 15 is separated from the clamp 16, and similarly recovered to its original condition so as to release the clamping of the cable. Moreover, responding to the movement, the key ring 17 moves to the side opposite the sleeve 18, and loosens the engagement of with the key groove 21 of the sleeve 18 so as to allow rotation of the sleeve 18.

Lastly, working principle of the configuration will be described with reference to FIG. 1. As obvious from the above description, when the protruding key 42 of the key ring 17 and the key groove 21 of the sleeve 18 are engaged, that is, when the plug connector 2 and the receptacle connector 8 are fitted to each other, the rotation of the insulating case 14 relative to the receptacle 8 is restricted, and the rotation of the key ring 17 relative to the insulating case 14 is also restricted. Therefore, as long as the protruding key 42 of the key ring 17 and the key groove 21 of the sleeve 18 engage to each other, it is impossible to rotate the sleeve 18 relative to the receptacle 8.

Furthermore, unless the engagement between the protruding key 42 of the key ring 17 and the key groove 21 of the sleeve 18 is not loosened, more specifically, unless the clamping of the cable with the tightening members is not released by rotating the tightening ring 13 relative to the insulating case 14 so as to move the tightening members such as the tightening ring 13, the gasket 15, and the clamp 16 on the opposite side to the sleeve 18, it is impossible to rotate. Therefore, it is possible to prevent the problem in the conventional technique, connection damage by wrong handling, i.e., separating the plug connector 2 from the receptacle connector 8 with the sleeve 18 by rotating the sleeve 18 without loosening the clamping of the cable with the tightening member.

In case of rotating the sleeve 18 without loosening the clamping of the cable 9 with the tightening members and separating the plug connector 2 from the receptacle connector 8 together with the sleeve 18, the plug 10 of the plug connector 2 remains locked in the receptacle 81 provided in the receptacle connector 8, and the cable secured in the tightening members of the plug connector 2 and also the plug 10 connected thereto are pulled as well as the plug connector 2, so that there is a risk of damaging the latching structure between the plug 10 and the receptacle 81. According to the configuration, however, it is possible to prevent such risk.

According to the embodiment, the protruding key 42 is provided in the key groove 17 and the key groove 21 is provided in the sleeve 18. Alternatively, as shown in a modification example of FIGS. 8(*a*) and 8(*b*), a key groove 21' may be provided in a key groove 17' and a protruding key 42' may be provided in a sleeve 18'.

Figure 8:
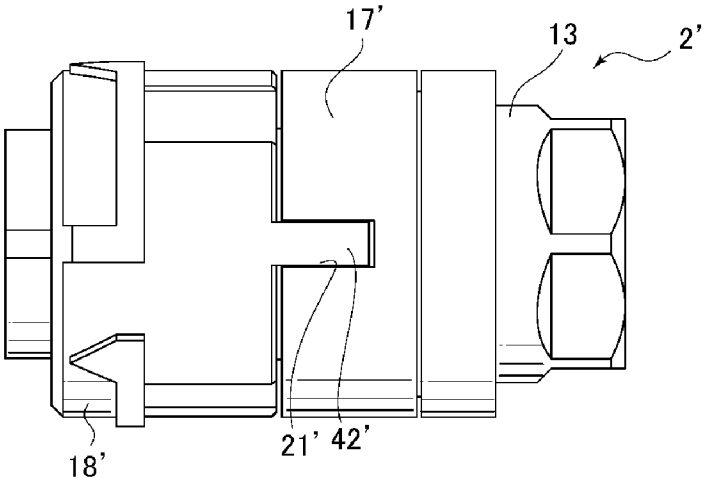
FIGS. 8(*a*) and 8(*b*) shows a modified example of the connector according to the present invention.
Figure 8:
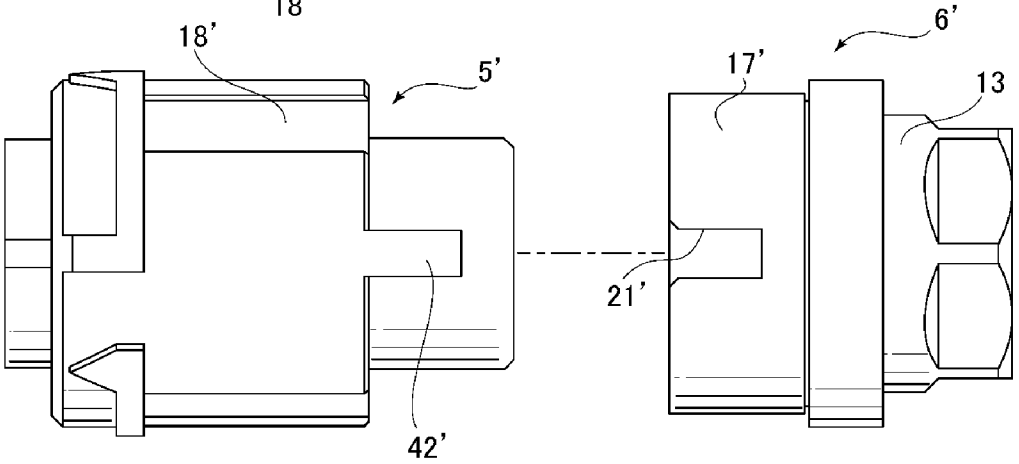
Figure 9:
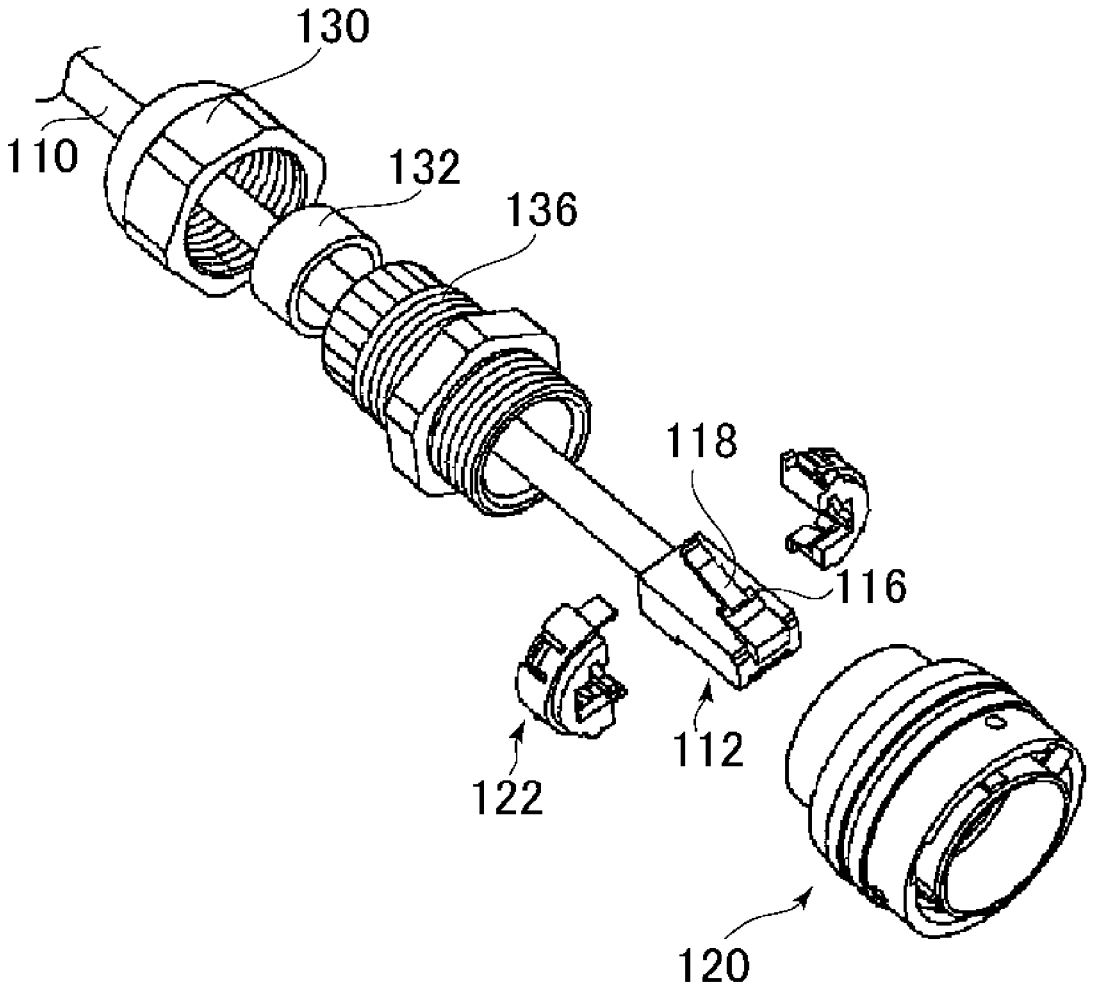
FIG. 9 Prior Art
FIG. 9 is a perspective view showing a conventional connector.

According to the modification example of FIGS. 8(*a*) and 8(*b*), the same reference numerals as in the above-described embodiment are used and the same reference numerals but affixed with "'" are used for corresponding members. Although it is not illustrated in those drawings, another embodiment of the present invention may be use of something other than the key. In addition, the shapes of the key ring 17 and the sleeve 18 may not be limited to those described above, and other configurations may be possible as long as it is impossible to rotate the sleeve 18 without releasing the engagement between the key ring 17 and the sleeve 18. For example, it is possible to provide a serrated saw blade-like jagged key. Therefore, the shape of the key shall not limit the scope of the present invention.

Application of the present invention may not be limited to a waterproof connector, and the present invention may be applicable in various plug connectors such as optical connectors and electrical connectors.

The disclosure of Japanese Patent Application No. 2012-285088 filed on Dec. 27, 2012, is incorporated in the application by reference.

While the present invention has been explained with reference to the specific embodiments of the present invention, the explanation is illustrative and the present invention is limited only by the appended claims.

What is claimed is:

1. A connector to be connected to a mating connector, comprising:

a base portion for accommodating a plug and a cable connected to the plug;

a connecting member disposed on the base portion to be rotatable relative to the mating connector for connecting the connector to the mating connector;

a tightening member disposed on the base portion to be movable relative to the connecting member for tightening the cable; and a rotation preventing member meshed with the base portion and the connecting member in a rotational direction thereof so that the rotation preventing member prevents the connecting member from rotating relative to the mating connector.

2. The connector according to claim 1, wherein said tightening member is arranged to loosen the cable when the tightening member moves away from the connecting member along the cable, and said rotation preventing member is arranged to move away from the connecting member so as to disengage from the connecting member so that the connecting member can rotate relative to the mating connector when the tightening member moves away from the connecting member along the cable.

3. The connector according to claim 1, wherein said tightening member includes an outside member exposed outside from the connecting member to be rotatable relative to the rotation preventing member, said tightening member further includes a first screw portion for engaging a second screw portion disposed on the base portion so that the outside member and the rotation preventing member move toward the connecting member when the tightening member rotates relative to the base portion.

4. The connector according to claim 1, wherein said base portion and said rotation preventing member includes an inclination adjusting member for adjusting an inclination of the rotation preventing member in the rotational direction thereof relative to the connecting member.

5. The connector according to claim 1, wherein said rotation preventing member includes a protrusion disposed along the cable for preventing the rotation preventing member from rotating, and said connecting member includes a groove extending along the cable for engaging with the protrusion.

6. The connector according to claim 1, wherein said connecting member includes a protrusion disposed along the cable for preventing the connecting member from rotating, and said rotation preventing member includes a groove extending along the cable for engaging with the protrusion.

7. A connector device, comprising:

the connector according to claim 1; and the mating connector connected to the connector.

* * * * *